United States Patent [19]

Mihara et al.

[11] Patent Number: 4,544,628

[45] Date of Patent: Oct. 1, 1985

[54] SILVER HALIDE PHOTOGRAPHIC EMULSION

[75] Inventors: Yuji Mihara; Satoshi Nagaoka; Masaki Okazaki, all of Kanagawa, Japan

[73] Assignee: Fuji Photo Film Co., Ltd., Kanagawa, Japan

[21] Appl. No.: 576,249

[22] Filed: Feb. 2, 1984

[30] Foreign Application Priority Data

Feb. 2, 1983 [JP] Japan ..... 58-15929

[51] Int. Cl.[4] ..... G03C 1/02

[52] U.S. Cl. ..... 430/572; 430/573; 430/576; 430/591; 430/600; 430/614

[58] Field of Search ..... 430/572, 573, 576, 591, 430/600, 614

[56] References Cited

U.S. PATENT DOCUMENTS

| | | | |
|---|---|---|---|
| 2,288,226 | 6/1942 | Carroll et al. | 430/599 |
| 3,583,870 | 6/1971 | Gilman | 430/588 |
| 3,769,025 | 10/1973 | Ohkubo et al. | 430/588 |
| 3,881,933 | 5/1975 | Kumai et al. | 430/588 |
| 4,135,931 | 1/1979 | Yoneyama et al. | 430/267 |

FOREIGN PATENT DOCUMENTS 52-18311 10/1977 Japan .

OTHER PUBLICATIONS

Chemical Abstracts, vol. 87, Item 93506d, 1977.

*Primary Examiner*—J. Travis Brown
*Attorney, Agent, or Firm*—Sughrue, Mion, Zinn Macpeak & Seas

[57] ABSTRACT

A silver halide photographic emulsion is disclosed which includes a sensitizing dye represented by general formula (I) and a compound represented by general formula (II):

(I)

(II)

The substituents within the general formulae are defined within the specification. The emulsion can be used to prepare a photographic material which has high green-sensitivity which is obtained without expanding the wavelength region of spectral sensitivity in the green sensitive region. Further, the resulting material has these improved results and does not show substantial change of its photographic properties such as sensitivity and amount of fogging during storage.

17 Claims, No Drawings

SILVER HALIDE PHOTOGRAPHIC EMULSION

FIELD OF THE INVENTION

The present invention relates to a spectrally sensitized silver halide photographic emulsion, and specifically to a silver halide photographic emulsion having enhanced spectral sensitivity at its green-sensitive region.

BACKGROUND OF THE INVENTION

It is well known that a technology which expands the sensitive wavelength region to the longer wavelength side by adding some kind of cyanine dye to silver halide photographic emulsions, i.e., spectral sensitization technology can be applied as one technology for the production of photosensitive materials. It is also known that the sensitivity obtained by spectral sensitization, i.e., spectral sensitivity is influenced by the chemical structure of sensitizing dyes and the properties of emulsion such as the halogen composition of silver halide, crystal habit, crystal system, silver ion concentration, hydrogen ion concentration, etc. Furthermore, this spectral sensitivity is also influenced by the additives for photography such as anti-fogging agent, coating auxiliary, sedimentation agent, color coupler, hardening agent, etc.

In general, a single sensitizing dye is employed to sensitize a definite spectral wavelength region in photosensitive materials. On the other hand, it is known that the efficiency of spectral sensitization remarkably increases when some kind of specifically selected dye or other organic substance exists other than the afore-mentioned dye. This effect is known as supersensitization. The supersensitization is a specific phenomenon because the addition of an additional dye or organic substance generally does not enhance the sensitivity and rather diminishes the sensitivity. Thus, extremely high selectivity is required of the organic substance or additional sensitizing dye which is used in this combination. Accordingly, an apparently small change in the chemical structure markedly influences this supersensitization. Therefore, it is difficult to obtain a suitable combination of compounds for use in supersensitization by a mere inference from the chemical structures thereof.

It is primarily important for the sensitizing dye which is used in the application of the supersensitization to the silver halide photographic emulsion to provide high spectral sensitivity. Secondly, strong sensitization of a specific narrow wavelength region is desired. Especially, in spectral sensitization at the green-sensitive region, it is necessary to provide higher sensitivity in a narrow wavelength region because the expansion of spectral sensitivity to the longer wavelength side and shorter wavelength side causes overlapping with the red-sensitive region and blue-sensitive region. This results in much color mixing, and in some cases, enhances the sensitivity to safety light which makes it difficult to handle.

Although sensitizing dyes which give the spectral sensitization called J-band are usually employed for this purpose, it is desired to give higher green-sensitivity without expanding the wavelength region of this spectral sensitivity, favorably with narrowing the wavelength region.

Furthermore, it is required that sensitizing dyes to be employed must not cause any undesirable interaction with color couplers or other photographic additives other than sensitizing dyes. Further, it is important to maintain stable photographic properties during the preservation of photosensitive materials It is also required for the sensitizing dyes that treated photosensitive materials containing them do not suffer residual coloration which may be caused by the sensitizing dyes. Especially, no residual coloration should occur for short period (usually several seconds to tens of seconds) treatment such as rapid treatment.

A further requirement is that the sensitizing dyes cause little fogging.

The combinations of the dyes which specially show supersensitization at the green-sensitive region are described in U.S. Pat. Nos. 3,580,724, 3,729,319, 3,397,060, etc. However, the technologies disclosed in these references are insufficient for obtaining photosensitive materials which have high green-sensitivity with little fogging, good preservation stability and little residual coloration.

SUMMARY OF THE INVENTION

A primary object of the present invention is to provide a high green-sensitive spectrally sensitized silver halide photographic emulsion.

Another object of the present invention is to provide a spectrally sensitized silver halide emulsion of high green-sensitivity without expanding the wavelength region of spectral sensitivity in the green-sensitive region.

A further object of the present invention is to provide a spectrally sensitized silver halide photographic emulsion which shows little change in the photographic properties such as sensitivity, fog, etc., during preservation.

As a result of extensive researches, the present inventors have now found that the above objects of the present invention are effectively accomplished by a silver halide photographic emulsion containing at least one sensitizing dye represented by the general formula (I) and at least one compound represented by the general formula (II) in combination.

(I)

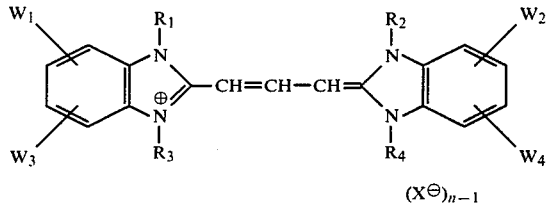

wherein $W_1$, $W_2$, $W_3$ and $W_4$, which may be the same or different, each represents a hydrogen atom, a halogen atom, (for example, a chlorine atom, a bromine atom, a fluorine atom, etc.), an alkyl group (having not more than 6 carbon atoms, for example, a methyl group, an ethyl group, etc.), a cycloalkyl group (having not more than 8 carbon atoms, for example, a cyclohexyl group, etc.), an alkenyl group (having not more than 6 carbon atoms, for example, an allyl group, etc.), more than 8 carbon atoms, for example, an acetyl group, a benzoyl group, a mesyl group, etc.), an acyloxy group (having not more than 3 carbon atoms, for example, an acetoxy group, etc.), an alkoxycarbonyl group (having not more than 8 carbon atoms, for example, a methoxycarbonyl group, an ethoxycarbonyl group, a benzyloxycarbonyl group, etc.), a carbamoyl group (having not more than 8 carbon atoms, for example, a carbamoyl group, an N,N-dimethylcarbamoyl group, a morpholinocarbonyl group, a piperidinocarbonyl group, etc.), a sulfamoyl group (having not more than 8 carbon atoms, for example, a sulfamoyl group, an N,N-dimethylsulfamoyl group, a morpholinosulfonyl group, a piperidinosulfonyl group, etc.), a cyano group, a trifluoromethyl group, or a hydroxy group.

$R_1$, $R_2$, $R_3$ and $R_4$, which may be the same or different, each represents an alkyl group (having not more than 8 carbon atoms, for example, a methyl group, an ethyl group, a propyl group, a butyl group, a pentyl group, etc.) which may be unsubstituted or substituted, a cycloalkyl group (having not more than 8 carbon atoms, for example, a cyclohexyl group, etc.) which may be unsubstituted or substituted, or an alkenyl group (having not more than 8 carbon atoms, for example, an alkyl group, etc.) which may be unsubstituted or substituted.

Examples of substituents for the above alkyl, cycloalkyl and alkenyl groups include a carboxy group, a sulfo group, a cyano group, a halogen atom (for example, a fluorine atom, a chlorine atom, a bromine atom, etc.), a hydroxy group, an alkoxycarbonyl group (having not more than 8 carbon atoms, for example, a methoxycarbonyl group, an ethoxycarbonyl group, a benzyloxycarbonyl group, etc.), an alkoxy group (having not more than 7 carbon atoms, for example, a methoxy group, an ethoxy group, a propoxy group, a butoxy group, a benxyloxy group, etc.), an aryloxy group (having not more than 12 carbon atoms, for example, a phenoxy group, a p-tolyloxy group, etc.), an acyloxy group (having not more than 3 carbon atoms, for example, an acetyloxy group, a propionyloxy group, etc.), an acyl group (having not more than 8 carbon atoms, for example, an acetyl group, a propionyl group, a benzoyl group, a mesyl group, etc.), a carbomoyl group (having not more than 8 carbon atoms, for example, a carbomoyl group, an N,N-dimethylcarbamoyl group, a morpholinocarbonyl group, a piperidinocarbonyl group, etc.), a sulfamoyl group (having not more than 8 carbon atoms, for example, a sulfamoyl group, an N,N-dimethylsulfamoyl group, a morpholinosulfonyl group, a piperidinosulfonyl group, etc.), an aryl group (having not more than 12 carbon atoms, for example, a phenyl group, a p-hydroxyphenyl group, a p-carboxyphenyl group, a p-sulfophenyl group, an $\alpha$-naphthyl group, etc.) and the like. The above alkyl, cycloalkyl and alkenyl groups may be substituted with two or more of these substituents in combination.

At least one of $R_3$ and $R_4$ represents a substituted alkyl, cycloalkyl or alkenyl group containing a sulfo group or a carboxy group as a substituent. More favorably, $R_3$ and $R_4$ both are substituted alkyl, cycloalkyl or alkenyl groups containing a sulfo group or a carboxy group.

X represents an acid anion. n represents 1 when the sensitizing dye of the general formula (I) forms an inner salt and represents 2 in the other cases.

(II)

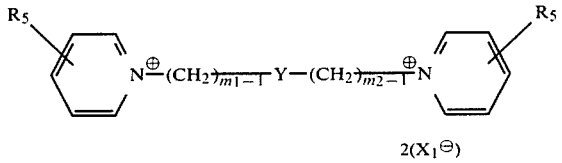

wherein $R_5$ represents a hydrogen atom, a halogen atom (for example, a fluorine atom, a chlorine atom, a bromine atom, an iodine atom, etc.), an alkyl group (having from 1 to 18 carbon atoms, for example, a methyl group, an ethyl group, a propyl group, etc.), an alkoxycarbonyl group (having from 1 to 18 carbon atoms, for example, a methoxycarbonyl group, an ethoxycarbonyl group, a butoxycarbonyl group, a benzyloxycarbonyl group, etc.), an acyloxy group (having from 1 to 18 carbon atoms, for example, an acetyloxy group, a propionyloxy group, a benzoyloxy group, a cyclohexylcarbonyloxy group, etc.), an alkoxy group (having from 1 to 18 carbon atoms, for example, a methoxy group, an ethoxy group, a propoxy group, a butoxy group, etc.), an amino group, a substituted group (having from 1 to 18 carbon atoms, for example, a methylamino group, an ethylamino group, a propylamino group, a dimethylamino group, a dodecylamino group, a cyclohexylamino group, a $\beta$-hydroxyethylamino group, an anilino group, a p-anisylamino group, an o-toluidino group, a 2-benzothiazolylamino group, etc.), an acylamido group (having from 1 to 18 carbon atoms, for example, an acetylamido group, a propionylamido group, a benzoylamido group, etc.), a carbamoyl group (having from 1 to 18 carbon atoms, for example, a carbamoyl group, an N,N-dimethylcarbamoyl group, a morpholinocarbonyl group, a piperidinocarbonyl group, etc.); Y represents an alkylene group having from 1 to 18 carbon atoms, an arylene group having from 6 to 18 carbon atoms, an aralkylene group having from 7 to 18 carbon atoms, —COO—, —COO—$Y_1$— OCO— in which $Y_1$ represents an alkylene group having from 1 to 18 carbon atoms, an arylene group having from 6 to 18 carbon atoms or an aralkylene group having from 7 to 18 carbon atoms.

$X_1$ represents an anion. $m_1$ and $m_2$ independently represent an integer of from 1 to 19.

DETAILED DESCRIPTION OF THE INVENTION

Specific examples of the sensitizing dye represented by the general formula (I) are shown below. However, the present invention is in no way limited thereto.

I-1

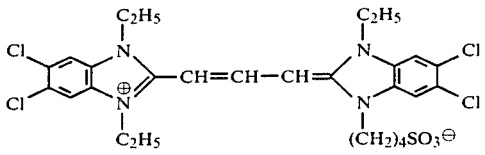

I-2

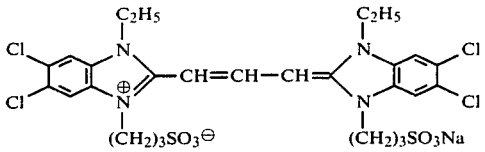

-continued
I-3
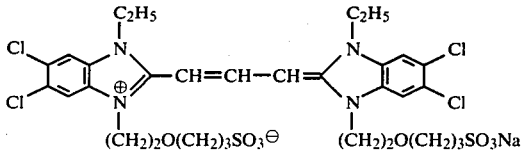
I-4
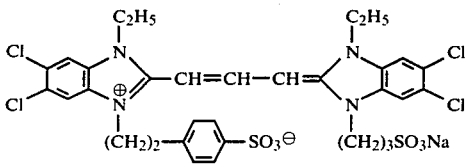
I-5
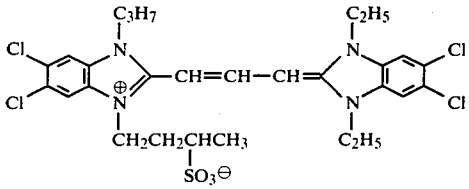
I-6
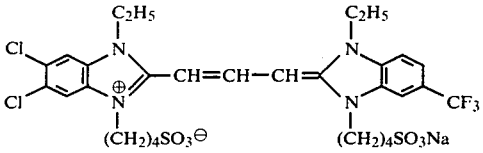
I-7
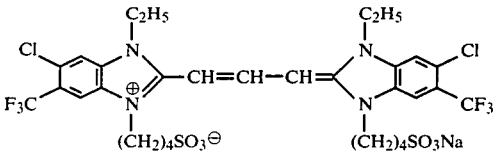
I-8
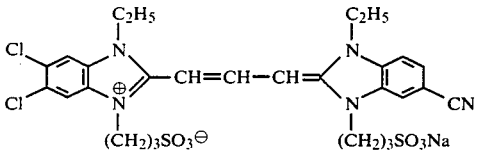
I-9
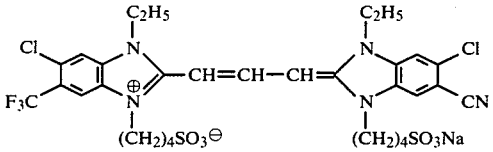
I-10
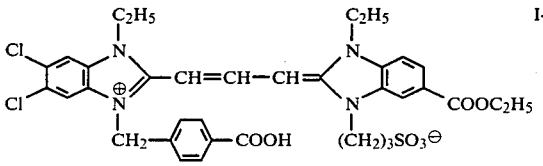
I-11
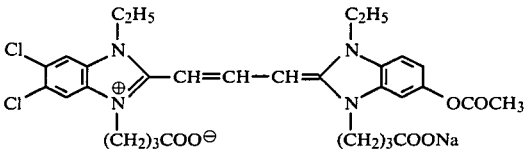
-continued
I-12
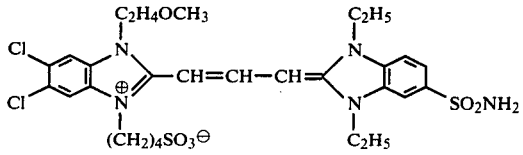
I-13
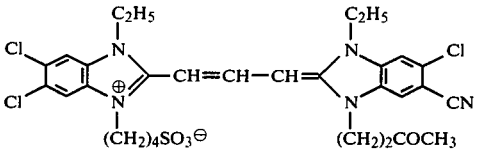
I-14
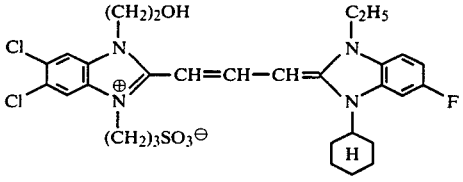
I-15
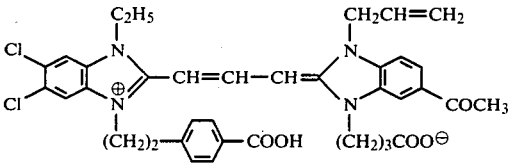
I-16
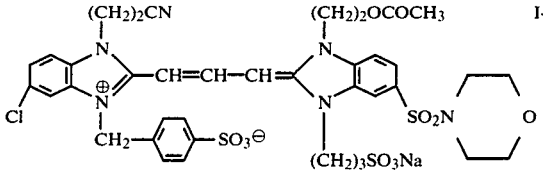
I-17
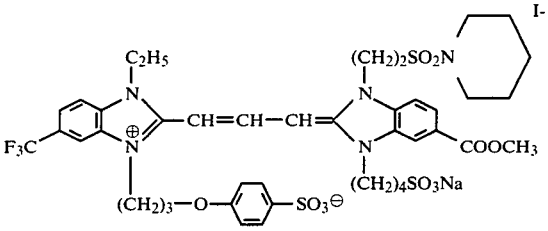
I-18
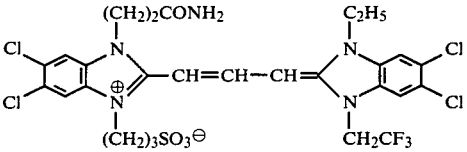
I-19
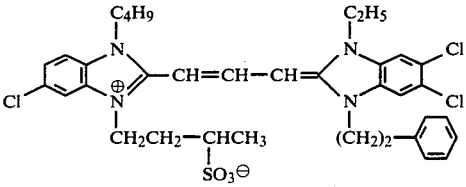
Specific examples of the compound represented by the general formula (II) are shown below. The present invention is, however, in no way limited to these compounds.

II-1
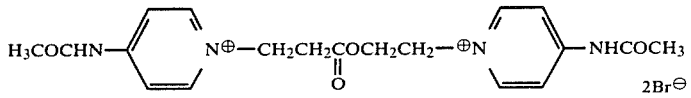
II-2
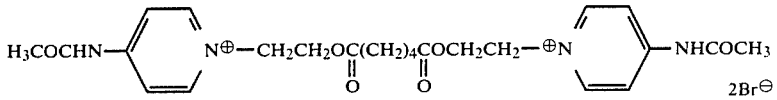
II-3
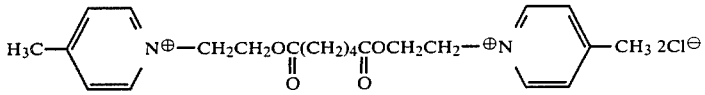
II-4
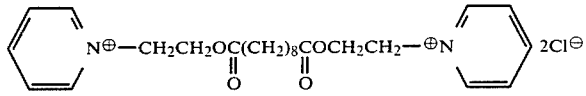
II-5
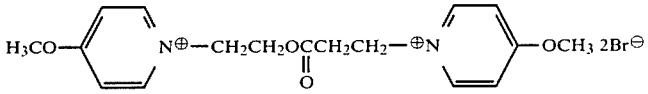
II-6
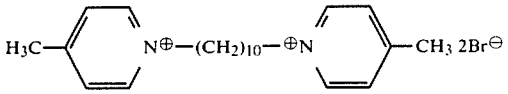
II-7
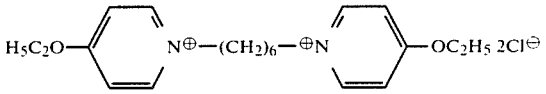
II-8
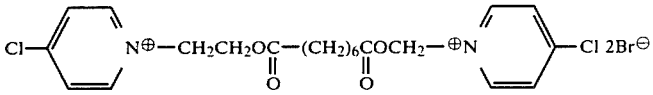
II-9
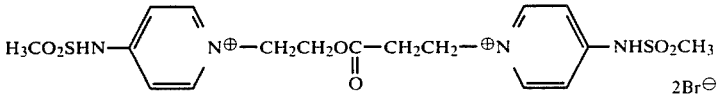
II-10
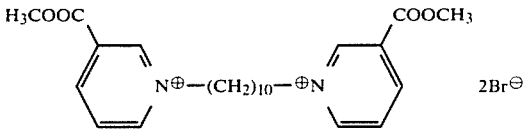
II-11
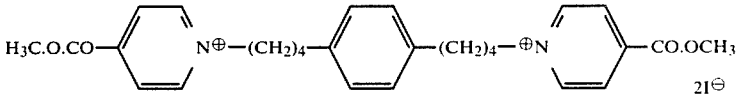
II-12
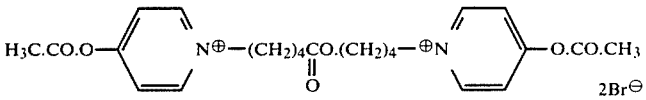
II-13
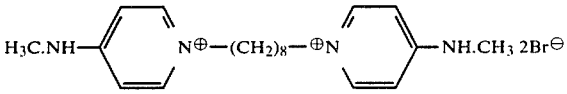
II-14
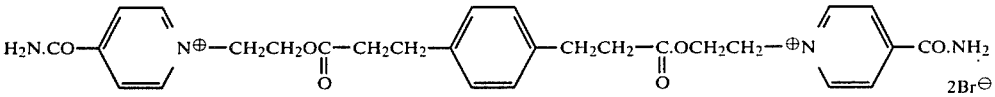
The sensitizing dyes of this invention represented by the general formula (I) are known compounds and can be easily synthesized according to the methods described in Japanese Patent Publication Nos. 13823/68 (corresponding to U.S. Pat. No. 3,793,020), 16589/69 (corresponding to U.S. Pat. No. 3,615,638), 9966/73 (corresponding to U.S. Pat. No. 3,656,959), 4936/68, and Japanese Patent Application (OPI) No. 82416/77 (the term "OPI" as used herein refers to a "published unexamined Japanese Patent Application").

The compounds represented by the general formula (II) are also known compounds and can be easily synthesized according to the method described in Japanese Patent Application (OPI) No. 44025/78.

The sensitizing dyes of this invention can be contained in an amount of from $1\times10^{-6}$ to $5\times10^{-3}$ mol per mol of silver halide, favorably from $1\times10^{-5}$ to $2.5\times10^{-3}$ mol per mol of silver halide, more favorably from $4\times10^{-5}$ to $1\times10^{-3}$ mol per mol of silver halide in the silver halide photographic emulsion.

The sensitizing dyes of this invention can be directly dispersed in the emulsion. Alternatively, they can be first dissolved in an appropriate solvent such as methyl alcohol, ethyl alcohol, methyl Cellosolve, acetone, water, pyridine or a mixture of these solvents and then added to the emulsion as a solution. Ultrasonic waves can also be employed for dissolving. Furthermore, various methods can be used for introducing the sensitizing dyes of the present invention into the emulsion. For example, a method comprising dissolving a dye into a volatile organic solvent, dispersing the solution into a hydrophilic colloid and adding the resulting dispersion into an emulsion as described in U.S. Pat. No. 3,469,987; a method comprising dispersing a water-insoluble dye into a water-soluble solvent without dissolving, and adding the resulting dispersion into an emulsion as described in Japanese Patent Publication No. 24185/71, etc.; a method comprising dissolving a dye into a surfactant, and adding the resulting solution into an emulsion as described in U.S. Pat. No. 3,822,135; a method comprising dissolving a dye using a compound which causes red-shift, and adding the resulting solution into an emulsion as described in Japanese Patent Application (OPI) No. 74624/76; a method comprising dissolving a dye into an acid which contains substantially no water, and adding the resulting solution into an emulsion as described in Japanese Patent Application (OPI) No. 80826/75. Furthermore, methods described in U.S. Pat. Nos. 2,912,343, 3,342,605, 2,996,287, 3,429,835 can also be employed for adding it to the emulsion. The above-mentioned sensitizing dyes can be homogeneously dispersed in the silver halide emulsion prior to applying the emulsion on an appropriate support, but needless to say, can be dispersed at any step.

The compound of this invention represented by the general formula (II) can be preferably used in an amount of from about 0.01 g to 5 g per mol of silver halide in the emulsion.

The ratio (weight ratio) of the sensitizing dye represented by the general formula (I) to the compound represented by the general formula (II) (=the dye represented by the general formula (I)/the compound represented by the general formula (II)) is favorably in the range of from 4/1 to 1/100, more preferably from 2/1 to 1/40.

The compound of this invention represented by the general formula (II) can be directly dispersed in the emulsion or can be added to the emulsion after dissolving it in an appropriate solvent (for example, methyl alcohol, ethyl alcohol, methyl Cellosolve, water, etc.) or any mixture of these solvents.

The compound can also be added to the emulsion as a solution or a dispersion in colloid in a manner similar to the methods of adding the sensitizing dyes.

Furthermore, the compound can be added and dispersed in an emulsion in a manner as described in Japanese Patent Application (OPI) No. 80119/75.

The sensitizing dyes of this invention can be used in combination with other sensitizing dyes. For example, the sensitizing dyes described in U.S. Pat. Nos. 3,703,377, 2,688,545, 3,397,060, 3,615,635 and 3,628,964, British Pat. Nos. 1,242,588 and 1,293,862, Japanese Patent Publication Nos. 4936/68, 14030/69 and 10773/68, U.S. Pat. No. 3,416,927, Japanese Patent Publication No. 4930/68, U.S. Pat. Nos. 3,615,613, 3,615,632, 3,617,295 and 3,635,721, etc., can be used.

Especially, the sensitizing dyes represented by the following general formula (III) can be used jointly.

(III)

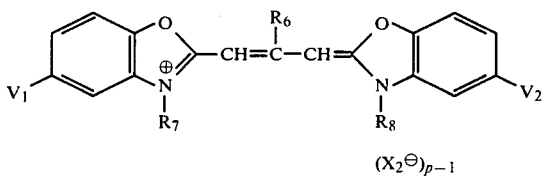

$(X_2^{\ominus})_{p-1}$ wherein $R_7$ and $R_8$ have the same meanings as $R_3$ and $R_4$, and at least one of $R_7$ and $R_8$ represents a substituted alkyl, cycloalkyl or alkenyl group substituted with sulfor group or a carboxy group; $R_6$ represents an ethyl group or a propyl group; $V_1$ and $V_2$ each represents an alkyl group (having not more than 4 carbon atoms, for example, a methyl group, an ethyl group, a propyl group, a butyl group, etc.), an alkoxy group (having not more than 4 carbon atoms, for example, a methoxy group, an ethoxy group, a propoxy group, a butoxy group, etc.), a halogen atom (for example, a chlorine atom, a bromine atom), a phenyl group, a carboxy group, a hydroxy group, etc.; $X_2$ represents an acid anion; and p represents 1 or 2.

Specific examples of the sensitizing dyes represented by the general formula (III) are shown below.

III-1

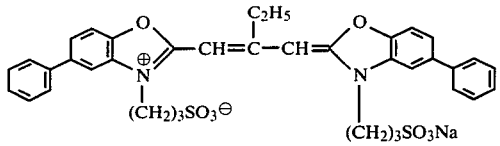

III-2

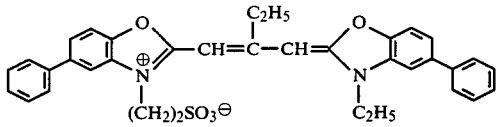

III-3

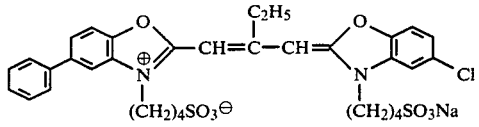

III-4

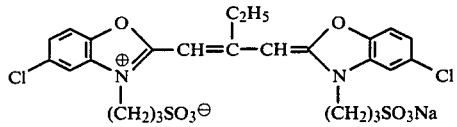

-continued

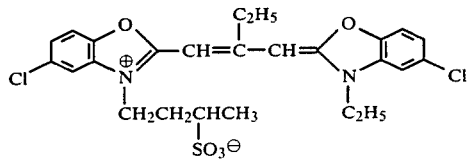

III-5

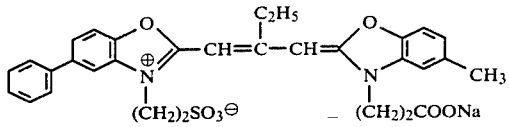

III-6

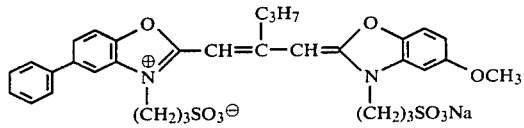

III-7

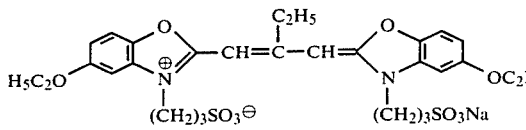

III-8

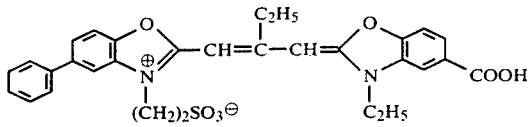

III-9

The sensitizing dyes represented by the general formula (III) can be used in such an amount that the molar ratio of the sum of the sensitizing dye of the general formula (I) and the sensitizing dye of the general formula (III) to the silver halide is from $1\times10^{31\ 6}$ to $5\times10^{-3}$ mol per mol of silver halide, favorably from $1\times10^{-5}$ to $2.5\times10^{-3}$ mol per mol of silver halide, and more favorably from $4\times10^{-5}$ to $1\times10^{-3}$ mol per mol of silver halide in the silver halide photographic emulsion. Further, the molar ratio of the sensitizing dye of the formula (III) to the sensitizing dye of the formula (I) is from 1:10 to 10:1.

For introducing the dyes into emulsions, methods similar to those mentioned of for the sensitizing dyes represented by the general formula (I) can be employed.

Silver halide to be used in this invention may be any of silver chloride, silver bromide, silver iodide, silver chlorobromide, silver chloroiodide, silver iodobromide, silver chloroiodobromide, etc. In this invention, among the above-mentioned silver halides, silver chlorobromide and silver iodobromide are especially preferred.

These emulsions may include rough particles, fine particles or their mixed particles, and these silver halide particles can be formed by means of well known methods such as a single jet method, a double jet method or a controlled double jet method. The crystalline structure of the silver halide particles can be homogeneous in the inner part, layered structure different in the inner part and outer part, so-called conversion type as described in British Pat. No. 635,841 and U.S. Pat. No. 3,622,318. The type in which a latent image is formed mainly at the surface and inner image type in which a latent image is formed at the inner part of the particles can both be used. These photographic emulsions are also described in books such as *The Theory of Photographic Process*, written by Mees, published by Macmillan Inc., *Photographic Chemistry*, written by Glafkides, published by Fountain Press Inc. and can be prepared according to various well known methods such as the ammonia method, neutral method, acidic method, etc. After these silver halide particles were formed, the particles are washed with water to remove water-soluble salts (for example, potassium nitrate when silver bromide was prepared from silver nitrate and potassium bromide) which is formed as a by-product, and then treated with heat in the presence of a chemical sensitizer to increase the sensitivity without roughening the particles. This treatment can be also conducted without removal of the water-soluble salts formed as a by-product. These general methods are described in the above-mentioned books.

The mean diameter of silver halide particles (measured by, for example, projected area method or number average) is preferably between about 0.04μ and 4μ.

During the formation process of the silver halide particles, the following can be used as a solvent for silver halide in order to control the growth of particles: ammonia, potassium rhodanide, ammonium rhodanide, thioether compounds (for example, U.S. Pat. Nos. 3,271,157, 3,574,628, 3,704,130, 4,297,439, 4,276,374, etc.), thione compounds (for example, Japanese Patent Application (OPI) Nos. 144319/78, 82408/78, 77737/80, etc.), amine compounds (for example, Japanese Patent Application (OPI) No. 100717/79, etc.) and the like.

For chemical sensitization of silver halide photographic emulsion, the usual chemical sensitizing methods such as gold sensitization (U.S. Pat. Nos. 2,540,085, 2,597,876, 2,597,915, 2,399,083, etc.), sensitization with group VIII metal ion (U.S. Pat. Nos. 2,448,060, 2,540,086, 2,566,245, 2,566,263, 2,598,079, etc.), sulfur sensitization (U.S. Pat. Nos. 1,574,944, 2,278,947, 2,440,206, 2,410,689, 3,189,458, 3,415,649, etc.), reductive sensitization (U.S. Pat. Nos. 2,518,698, 2,419,974, 2,983,610, etc.), sensitization with a thioether compound (for example, U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,671,260, 3,574,709, 3,625,697, 3,635,717, 4,198,240, etc.) and combinations of the various sensitizations can be applied.

The following is an example of a specific chemical sensitizer: sulfur sensitizers such as allyl thiocarbamide, thiourea, sodium thiosulfate or cystine, etc.; noble metal sensitizers such as potassium chloroaurate, aurous thiosulfate, potassium chloropaladate, etc., reductive sensitizers such as tin chloride, phenylhydrazine, reductone, etc.

Other sensitizers such as polyoxyethylene derivatives (British Pat. No. 981,470, Japanese Patent Publication No. 6475/56, U.S. Pat. No. 2,716,062, etc.), polyoxypropylene derivatives, derivatives having quaternary ammonium group and the like can also be used.

Various compounds can be added to the photographic emulsion of this invention in order to prevent the sensitivity drop or occurrence of fogging in the process of production or preservation of the photosensitive materials. Many compounds are heretofore known to be useful, which include heterocyclic compounds, mercury-containing compounds, mercapto compounds, metal salts, etc., for example, nitrobenzimidazole, ammonium chloroplatinate, 4-hydroxy-6-methyl-1,3,3a,7-tetraazaindene, 3-methylbenzothiazole, 1-phenyl-5-mercaptotetrazole, etc. The following can be illustrated, which are described in pp. 344–349 of *The Theory of the Photographic Process* (Third Edition, 1966) with reference to original references: thiazolium salts described in U.S. Pat. Nos. 2,131,038, 2,694,716, etc.; azaindenes described in U.S. Pat. Nos. 2,886,437, 2,444,605, etc.; urazoles described in U.S. Pat. No. 3,287,135, etc.; sulfocatechols described in U.S. Pat. No. 3,236,652, etc.; oximes described in British Pat. No. 623,448, etc.; mercaptotetrazoles described in U.S. Pat. Nos. 2,403,927, 3,266,897, 3,397,987, etc.; nitron; nitroindazoles; polyvalent metal salts described in U.S. Pat. No. 2,839,405, etc.; thiuronium salts described in U.S. Pat. No. 3,220,839, etc.; salts of palladium, platinum or gold described in U.S. Pat. Nos. 2,566,263, 2,597,915, etc.

Silver halide photographic emulsions used can contain developing agents such as hydroquinones, catechols, aminophenols, 3-pyrazolidones, ascorbic acid and its derivatives, reductones, phenylenediamines or combination of developing agents. The developing agent can be added to silver halide emulsion layers and/or other photographic layers (for example, a protecting layer, an intermediate layer, a filter layer, an antihalation layer, a back layer, etc.). The developing agent can be added as a solution in an appropriate solvent or a dispersion described in U.S. Pat. No. 2,592,368 and French Pat. No. 1,505,778, etc.

The hardening treatment of the emulsion can be conducted according to the usual method. Examples of useful hardening agents include aldehyde compounds such as formaldehyde, glutaraldehyde; ketonic compounds such as diacetyl, and cyclopentanedione; compounds having reactive halogen(s) such as bis(2-chloroethylurea), 2-hydroxy-4,6-dichloro-1,3,5-triazine and other compounds described in U.S. Pat. Nos. 3,288,775, 2,732,303 and British Pat. Nos. 964,723, 1,167,207, etc.; compounds having reactive olefin(s) such as divinyl sulfone, 5-acetyl-1,3-diacryloyl-hexahydro-1,3,5-triazine, and other compounds described in U.S. Pat. Nos. 3,635,718, 3,232,763, British Pat. No. 994,869, etc.; N-methylol compounds such as N-hydroxymethylphthalimide, and other compounds described in U.S. Pat. Nos. 2,732,316, 2,586,168, etc.; isocyanates described in U.S. Pat. No. 3,103,437, etc.; aziridines described in U.S. Pat. Nos. 3,017,280, 2,983,611, etc.; acid derivatives described in U.S. Pat. Nos. 2,725,294, 2,725,295, etc.; carbodiimides described in U.S. Pat. No. 3,100,704, etc.; epoxy compounds described in U.S. Pat. No. 3,091,537, etc.; isoxazoles described in U.S. Pat. Nos. 3,321,313, 3,543,292; halogenocarboxyaldehydes such as mucochloric acid; dioxanes such as dihydroxydioxane, dichlorodioxane, etc.; or as inorganic hardening agent, chloro alum, zirconium sulfate, etc. Instead of the above compounds, the precursors such as alkali metal bisulfite aldehyde adduct, methylol derivatives of hydantoin, primary aliphatic nitro alcohol, etc., can be used.

The photographic emulsion of this invention may contain one or more surfactants alone or in combination.

These are used as coating auxiliary. However, in some cases, they are also used for other purposes such as emulsifying dispersion, improvement of sensitized photographic properties, prevention of charging and prevention of adhesion. These surfactants can be classified as natural surfactants such as saponin, etc., nonionic surfactants such as alkylene oxides, glycerins, glycidols, etc., cation surfactants such as higher alkylamines, quaternary ammonium salts, heterocycles such as pyridine, phosphonium or sulfonium salts, etc., anion surfactants containing acidic group such as carboxylic acid, sulfonic acid, phosphoric acid, sulfuric acid ester group, phosphoric acid ester group, etc., amphoteric surfactants such as amino acids, amino sulfonic acids, sulfuric or phosphoric acid esters of amino alcohol.

Some of these surfactants are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, German Patent Application (OLS) No. 1,942,665, British Pat. Nos. 1,077,317 and 1,198,450 and books such as *Kaimen Kasseizai no Gosei to sono Oyo (Synthesis and Application of Surfactants)*, written by Ryohei Oda, et al. (Maki Shoten, 1964) and *Surface Active Agents*, written by A. W. Perry (Interscience Publication Inc., 1958), and *Encyclopedia of Surface Active Agents*, Second Vol., written by J. P. Sisley (Chemical Publishing Co. 1964), etc.

The silver halide photographic emulsion of this invention can contain, as a protective colloid, gelatin and the following: acylated gelatin such as phthalated gelatin and malonated gelatin, cellulose compounds such as hydroxyethyl cellulose and carboxymethyl cellulose, soluble starch such as dextrin, hydrophilic polymers such as polyvinyl alcohol, polyvinyl pyrrolidone, polyacrylamide and polystyrene sulfonic acid, plasticizer for dimensional stabilization, latex polymer or matting agents.

The silver halide photographic emulsion can also contain antistatic agents, plasticizers, optical whitening agents, developing accelerators, anti-airfogging agents, tone modifying agents, etc. Specifically, those described in *Research Disclosure*, Vol. 176, RD-17643 (December, 1978) can be used.

The silver halide photographic emulsion of this invention can contain color couplers such as cyan couplers, magenta couplers, yellow couplers, etc., and the compounds which disperse the couplers.

Namely, compounds which can develop color during color development process by oxidative coupling with an aromatic primary amine developing agent (for example, phenylenediamine derivatives, aminophenol derivatives, etc.) can be contained. Examples of the coupler include magenta couplers such as 5-pyrazolone coupler, pyrazolobenzimidazole coupler, cyanoacetylchroman coupler, open-chain acylacetonitrile coupler, etc., yellow couplers such as acylacetamide coupler (for example, benzoylacetanilides and pivaloylacetanilides), etc., and cyan couplers such as naphthol coupler, phenol coupler, etc. These couplers are favorably non-diffusion type having a hydrophobic group called "ballast group" in the molecule. The coupler may be 4-equivalent type or 2-equivalent type with respect to silver ions. The coupler may also be a colored coupler which shows a color correction effect, or a coupler which releases an inhibitor for the development as development proceeds (so-called DIR coupler).

Furthermore, the silver halide photographic emulsion of this invention can contain, besides DIR couplers, colorless DIR couplers which provide a colorless product by a coupling reaction and release development inhibitors.

Of the color couplers, especially magenta couplers can be used. They may be 4-equivalent magenta couplers or 2-equivalent magenta couplers, favorably 2-equivalent magenta couplers.

Specific examples of magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, Japanese Patent Application (OPI) No. 46223/81, Japanese Patent Application No. 136497/79, U.S. Pat. Nos. 4,310,623 and 4,407,936, etc.

Specific examples of yellow developing couplers are described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Specific examples of cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77, 90932/77 and 109630/78.

It is preferred to use a cyan coupler having a ureido group which is improved in the decoloration of the resulting dye, since better stability to light and heat can be obtained.

Examples of such couplers include those described in U.S. Pat. Nos. 3,446,622, 3,996,253, 3,758,308 and 3,880,661, Japanese Patent Application (OPI) Nos. 65134/81, 98731/83 and 118643/83, and GB-A-2119944, etc.

Colored couplers, for example, those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and West German Patent Application (OLS) No. 2,418,959 can be used.

DIR couplers, for example, those described in U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77, and 122335/74, Japanese Patent Publication No. 16141/76 can be used.

In addition to DIR couplers, the photosensitive material can contain compounds which release development inhibitors as development proceeds and those described in U.S. Pat. Nos. 3,297,445 and 3,379,529, West German Patent Application (OLS) No. 2,417,914, and Japanese Patent Application (OPI) Nos. 15271/77 and 9116/78 can be used.

The above-mentioned couplers can be used in combination in the same layer and the same compound can be added to two or more layers in order to satisfy the properties required for photosensitive materials.

The above couplers include couplers having water-soluble groups such as a carboxy group, a hydroxy group, a sulfo group, etc., and hydrophobic couplers, each of which is introduced to the emulsion according to the heretofore known adding methods or dispersing methods. In the case of hydrophobic couplers, the following can be applied: the method of mixing the coupler with organic solvents of high boiling point such as phthalic acid esters, trimellitic acid esters, phosphoric acid esters, fatty oils and waxes which are liquid at room temperature, etc., and dispersing them by the aid of an anionic surfactant, for example, the method described in U.S. Pat. Nos. 2,304,939, 2,322,027, etc.; the method of mixing the coupler with organic solvent of low boiling point or water-soluble organic solvent and dispersing them, for example, the method described in U.S. Pat. Nos. 2,801,170, 2,801,171, 2,949,360, etc.; the method of dispersing the coupler alone or in combination with other coupler(s) to be used together, e.g., colored couplers, DIR couplers and other couplers, when the coupler itself has sufficiently low melting point (favorably not more than 75° C.), for example, the method described in German Pat. No. 1,143,707, etc. Water-soluble couplers can be added as an alkaline solution or can be added with hydrophobic couplers as dispersing auxiliary of hydrophobic couplers (as one anionic surfactant).

Moreover, color images can be also formed by developing with color developing solutions containing diffusive couplers.

Those described in, for example, Japanese Patent Publication Nos. 20389/66, 3504/68 and 13168/68, U.S. Pat. Nos. 2,697,037, 3,423,207 and 2,865,752, British Pat. Nos. 1,030,392 and 1,100,546, etc., can be used as dyes for anti-irradiation which are added according to purposes.

The present invention can be applied to not only black-and-white photographic emulsions but also silver halide emulsions for various color photosensitive materials. Such emulsions include color positive emulsions, color paper emulsions, color negative emulsions, color reversal emulsions (the case containing couplers or the case containing no couplers), emulsions for color diffusion transfer processes (described in U.S. Pat. Nos. 3,087,817, 3,185,567, 2,983,606, 3,253,815, 3,227,550, 3,227,551, 3,227,552, 3,415,644, 3,415,645, 3,415,646, etc.), emulsions for dye transfer processes (described in U.S. Pat. No. 2,882,156, etc.), emulsions for silver dye bleaching methods (described in *History of Color Photography*, written by Friedman, American Photographic Publishers Co., 1944, especially its chapter 24, and *British Journal of Photography*, Vol. 111, pp. 308–309, Apr. 7, 1964, etc.).

Exposure for obtaining photographic images can be conducted according to usual methods. Namely, any of the known various light sources such as natural light (sunlight), tungsten lamp, fluorescent lamp, mercury lamp, xenon arc lamp, carbon arc lamp, xenon flash lamp, cathode-ray tube flying spot, etc., can be employed. Exposure times may be not only from 1/1,000 second to 1 second which is generally used with usual cameras but also shorter exposure times than 1/1,000 second such as an exposure time of $1/10^4$ to $1/10^6$ second by means of xenon flash lamp or cathode-ray tube and longer exposure times than 1 second. If desired, spectral composition of the light used for exposure can be controlled by means of color filters. Laser light can be also used for exposure. Exposure may be conducted using the light irradiated from fluorescent substances excited by electron beam, X-ray, $\gamma$-ray, $\alpha$-ray, etc.

The layer structure of multilayer color photosensitive materials applicable to this invention is not limited. For example, a support may be coated in the order of blue-sensitive layer (B), green-sensitive layer (G), red-sensitive layer (R), in the order of (R), (G), (B), or in the order of (B), (R), (G). In the case of the order of (R), (G), (B), use of a yellow filter between (G) and (B) is favorable.

Silver halide photographic emulsions are applied on supports with other photographic layer(s), if desired. Namely, various coating methods including dip coating, air-knife coating, curtain coating or extrusion coating using a hopper described in U.S. Pat. No. 2,681,294 can be employed.

According to necessity, two or more kinds of layers can be coated at once using the methods described in U.S Pat. Nos. 2,761,791, 3,508,947, 2,941,898 and 3,526,528, etc.

Finished emulsion is applied on an appropriate support.

Useful supports include flat materials which do not cause remarkable dimensional change during treatment, for example, hard supports such as glass, metal, china, as well as pliable supports. Typical pliable supports include cellulose nitrate film which is usually used for photographic photosensitive materials, cellulose acetate film, cellulose acetate butyrate film, cellulose acetate propionate film, polystyrene film, polyethylene terephthalate film, polycarbonate film, laminated materials of these, thin glass film, paper, etc. Supports of baryta, α-olefin polymer especially polyethylene, polypropylene, ethylene-butene copolymer, etc., paper coated or laminated with α-olefin polymer having 2 to 10 carbon atoms, plastic films which have good fitness and increased printability by roughening the surface as shown in Japanese Patent Publication No. 19068/72 also afforded good results.

Depending on the purpose of the photosensitive material, clear ones or unclear ones may be selected from these supports. In the case of clear supports, those other than clear colorless one, can be formed by adding a dye or pigment. This coloring is heretofore carried out with X-ray film, etc., and is also known in *J. SMPTE.*, Vol. 67, p. 296 (1958), etc.

Unclear supports include, in addition to originally unclear supports such as paper, etc., those to which dye or pigment such as titanium oxide was added to a clear film, plastic films which have their surface treated by the method described in Japanese Patent Publication No. 19068/72, and papers or plastic films which perfectly shield the light by adding carbon black, dye, etc. When the adhesion power of the support to photographic emulsion is insufficient, a layer which is adhesive to both of them can be used as a subbing layer. Furthermore, in order to increase the adhesion ability, the surface of the support can be pre-treated by corona discharge, irradiation by ultraviolet ray, flame treatment, etc.

Conventionally known methods can be employed for photographic treatment of the photosensitive material of this invention. Conventional treating solutions can be used. The treating temperature is generally selected from 18° C. to 50° C., but may be below 18° C. or above 50° C. Depending on purposes, developing treatment which forms a silver picture image (black-and-white photographic treatment) or color photographic treatment which involves a developing treatment to form dye image can be applied.

Developing solutions for black-and-white photographic treatment can contain known developing agents. Examples of useful developing agents include dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid, heterocyclic compounds formed by condensation of 1,2,3,4-tetrahydroquinoline ring with indolene ring described in U.S. Pat. No. 4,067,872, and the like, which can be used alone or in combination. The developing solution generally contains other conventional additives such as preservatives, alkaline agents, pH buffers, anti-fogging agents, etc., and if desired, a dissolving aids, tone adjusting agents, developing accelerators, surfactants, anti-foaming agents, hard water softeners, hardening agents, viscosity increasing agents, etc.

In the photographic emulsion of this invention, so-called "lithographic type" developing treatment can be applied. The "lithographic type" developing treatment means a developing treatment in which the developing process was conducted infectiously at low sulfite ion concentrations generally using dihydroxybenzenes as developing agents for photographic reproduction of line images or photographic reproduction of halftone images by dots (details are described in *Photographic Processing Chemistry*, written by Mason, pp. 163–165 (1966)).

Conventional fixing agents can be employed.

The fixing agents include organic sulfur compounds whose effect as fixing agents is known, as well as thiosulfate salts and thiocyanate salts.

Fixing solutions used may contain water-soluble aluminum salts as hardening agents.

Usual methods can be applied for the formation of dye images. For example, the following methods can be employed: negative-positive method (for example, described in *Journal of the Society of Motion Picture and Television Engineers*, Vol. 61, pp. 667–701 (1953)); color reversal method where dye positive image is obtained by development with a developing solution containing black-and-white developing agent to give negative silver image, homogeneous exposure (at least once) or other appropriate fogging treatment, and successive color development; silver dye bleaching method in which a silver image is formed by developing an exposed photographic emulsion layer containing a dye and then the dye is bleached using the resulting image as a bleaching catalyst.

The silver halide photographic material of this invention can be color-developed by means of aromatic primary amine compounds such as p-phenylenediamine.

Typical examples of the color developing agents include inorganic salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 3-methyl-4-amino-N-ethyl-N-(β-hydroxyethyl)aniline, etc., 4-amino-3-methyl-N-ethyl-N-(β-methanesulfonamidoethyl)aniline sesquisulfate monohydrate described in U.S. Pat. No. 2,193,015, N-(2-amino-5-diethylaminophenylethyl)methanesulfonamide sulfuric acid salt, N,N-dimethyl-p-phenylenediamine hydrochloric acid salt, 3-methyl-4-amino-N-ethyl-N-methoxyethylaniline described in Japanese Patent Application (OPI) No. 64933/73 and the like.

Details of these color developing agents are described in pp. 226–229 of *Photographic Processing Chemistry*, written by L. F. A. Mason (Focal Press, London, 1966), etc. Furthermore, the developing agents can be used together with 3-pyrazolidones.

To color developing solutions, various additives can be added, if desired.

Examples of the additives for the developing solution include alkaline agents (e.g., hydroxides, carbonates, and phosphates of alkali metal or ammonium), pH controlling or buffering agents (e.g., weak acids such as acetic acid and boric acid, weak bases, and their salts), developing accelerators (e.g., various pyridinium compounds described in U.S. Pat. Nos. 2,648,604, 3,671,247, etc., cationic compounds, potassium nitrate and sodium nitrate, condensate of polyethylene glycol and its derivatives described in U.S. Pat. Nos. 2,533,990, 2,577,127, 2,950,970, etc., nonionic compounds such as polythioethers represented by the compounds described in British Pat. Nos. 1,020,033 and 1,020,032, polymer compounds having sulfite esters represented by the compounds described in U.S. Pat. No. 3,068,097, organic amines such as pyridine, ethanolamine, etc., benzyl alcohol, hydrazines, etc.), anti-fogging agent (e.g., alkali bromide, alkali iodides, nitrobenzimidazoles described in U.S. Pat. Nos. 2,496,940 and 2,656,271, mercaptobenzimidazole, 5-methylbenzotriazole, 1-phenyl-5-mercaptotetrazole, compounds for rapid treatment solution described in U.S. Pat. Nos. 3,113,864, 3,342,596, 3,295,976, 3,615,522, 3,597,199, etc., thiosulfonyl compounds described in British Pat. No. 972,211, or phenazine N-oxides described in Japanese Patent Publication No. 41675/71, a fog suppressing agent described in pp. 29–47 of *Kagaku Shashin Binran (Scientific Photographic Handbook)*, Middle Volume, and the like), stain or sludge preventing agents described in U.S. Pat. Nos. 3,161,513, 3,161,514, British Pat. Nos. 1,030,442, 1,144,481 and 1,251,558, interlayer effect accelerator described in U.S. Pat. No. 3,536,487, etc., and preservatives (e.g., sulfites, hydrogen sulfites, hydroxylamine hydrochloride, formsulfite, alkanolamine sulfite adducts, etc.).

The silver halide photographic emulsion is fixed following the usual methods after development, and in some cases, bleaching treatment can be conducted. The bleaching treatment can be conducted during fixing step or another step. When bleaching and fixing are conducted at the same time, a bleach-fixing bath can be prepared by adding bleaching agents and fixing agents. Many compounds are used as bleaching agents. Among them, ferricyanides, dichromates, water-soluble cobalt (III) salts, water-soluble copper (II) salts, water-soluble quinones, nitrosophenol, polyvalent metal compounds such as iron (III), cobalt (III), copper (II), etc., especially complex salts of these polyvalent metal cations with organic acid such as metal complexes with amino polycarboxylic acid such as ethylenediamine tetraacetic acid, nitrilotriacetic acid, iminodiacetic acid and N-hydroxyethylethylenediamine triacetic acid, malonic acid, tartaric acid, malic acid, diglycolic acid, dithioglycolic acid, etc., copper complex salt of 2,6-dipicolinic acid, etc., peracids such as alkyl peracids, persulfates, permanganates, hydrogen peroxide hypochloric acid salts such as chlorine, bromine, bleaching powder, etc., can be generally used alone or in appropriate combination. Bleaching and fixing, or bleach-fixing is described in U.S. Pat. No. 3,582,322, etc. To this treating solution, bleaching accelerators described in U.S. Pat. Nos. 3,042,520 and 3,241,966, Japanese Patent Publication Nos. 8506/70, 8836/70, etc., and other various additives can be added.

The present invention can be applied to photosensitive materials containing a small amount of silver from ca. one severalth to one hundredth as compared with the amount of usual photosensitive materials. With color photosensitive materials containing a small amount of silver halide, sufficient color picture images can be obtained by the following methods: the developing method of enhancing the amount of dye formed by repeated color developing after halogenation-bleaching the developed silver which was formed by color developing (e.g., U.S. Pat. Nos. 2,623,822, 2,814,565, etc.), picture image forming method of increasing the amount of dye utilizing color intensification with peroxides or cobalt complex salts (e.g., West German Patent Application (OLS) Nos. 1,598,076, 1,900,540, 1,900,864, 1,917,744, 2,044,833, 2,056,360, 2,226,770, 2,357,694, 2,357,695, U.S. Pat. Nos. 3,674,490, 3,761,265, 3,765,890, Japanese Patent Application (OPI) Nos. 9728/73, 9729/73, 84239/74, 84240/74, etc.), image forming method of increasing the amount of dye formed by utilizing color intensification using chlorous acid or bromous acid (e.g., Japanese Patent Application (OPI) Nos. 53826/76, 99022/76, etc.), and the like.

The present invention is described in greater detail with reference to examples below. However, the present invention is in no way limited thereto.

EXAMPLE 1

A silver iodobromide (iodine content 7.5 mol %) emulsion was obtained by precipitating particles of silver halide by means of a double jet method, physical ripening, treating for desalination and then chemical ripening. The mean diameter of the particles of silver halide contained in this emulsion was 0.85 micron. 1 kg of this emulsion contained 0.62 mol of silver halide.

After 1 kg of this emulsion was weighed out and heated to be dissolved at 40° C., a prescribed amount of a methanolic solution of a sensitizing dye and of a methanolic solution of a compound represented by the general formula (II) as shown in Table 1 and Table 2 were added to the emulsion and the whole was stirred for mixing. Then, 15 ml of 1.0 wt % aqueous solution of 4-hydroxy- 6-methyl-1,3,3a,7-tetraazaindene, 20 ml of 1.0 wt % aqueous solution of 1-hydroxy-3,5-dichlorotriazine sodium salt, and 10 ml of 1.0 wt % aqueous solution of dodecylbenzenesulfonic acid sodium salt were successively added and the whole was stirred. Samples of photosensitive material were obtained by coating a cellulose triacetate base film with the resulting finished emulsion so as that the dry film thickness was 5 microns, and drying the coated film. Light-wedge exposure of the film sample was conducted by means of sensitometer having a light source of color temperature of 5,400° K. provided with a yellow filter (SC-50) made by Fuji Photo Film Co., Ltd. After exposure, the sample was developed at 20° C. for 3 minutes by means of the developing solution of the following composition, dipped into stopping bath and fixing bath, and then washed with water to afford strips having desired black-and-white images. Sensitivity and fog were determined by density measurement of this sample by means of P type densitometer made by Fuji Photo Film Co., Ltd. The base point of the optical density which determined the sensitivity was the point of (fog+0.20).

| Composition of the Developing Solution | |
|---|---|
| Water | 500 ml |
| N—Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |

-continued

| Composition of the Developing Solution | |
|---|---|
| Adding water to make | 1 l |

The results obtained are shown in Table 1 and Table 2 as relative values. These results show that the combinations of this invention provide excellent sensitive materials with high sensitivity and little fog as compared with the case of dye alone or comparative examples.

TABLE 1

| Test No. | Sensitizing Dye and Amount ($\times 10^{-5}$ mol/ 1 kg emulsion) | | Compound of Formula (II) and Amount ($\times 10^{-5}$ mol/ 1 kg emulsion) | | Sensitivity | Fog |
|---|---|---|---|---|---|---|
| 1 | I-2 | 20 | | | 100 (base) | 0.04 |
| 2 | I-2 | 20 | II-1 | 20 | 126 | 0.04 |
| 3 | | 20 | | 40 | 148 | 0.03 |
| 4 | | 20 | | 80 | 151 | 0.03 |
| 5 | I-2 | 20 | II-2 | 20 | 138 | 0.03 |
| 6 | | 20 | | 40 | 191 | 0.03 |
| 7 | | 20 | | 80 | 191 | 0.03 |
| 8 | I-2 | 20 | II-4 | 20 | 123 | 0.04 |
| 9 | | 20 | | 40 | 151 | 0.03 |
| 10 | | 20 | | 80 | 151 | 0.03 |
| 11 | I-2 | 20 | II-6 | 20 | 120 | 0.03 |
| 12 | | 20 | | 40 | 148 | 0.03 |
| 13 | | 20 | | 80 | 173 | 0.03 |
| 14 | I-2 | 20 | II-8 | 20 | 132 | 0.04 |
| 15 | | 20 | | 40 | 155 | 0.04 |
| 16 | | 20 | | 80 | 170 | 0.03 |
| 17 (comparison) | I-2 | 20 | Compound A | 20 | 100 | 0.05 |
| 18 (comparison) | | 20 | | 40 | 105 | 0.06 |
| 19 (comparison) | | 20 | | 80 | 95 | 0.07 |

Compound A:
The compound described in British Patent 1,098,748.

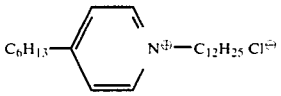

TABLE 2

| Test No. | Sensitizing Dye and Amount ($\times 10^{-5}$ mol/ 1 kg emulsion) | | Compound of Formula (II) and Amount ($2 \times 10^{-5}$ mol/ 1 kg emulsion) | | Sensitivity | Fog |
|---|---|---|---|---|---|---|
| 1 | | | II-2 | 40 | — | 0.03 |
| 2 | I-1 | 5 | II-2 | 40 | 100 (base) | 0.04 |
| 3 | | 10 | | 40 | 145 | 0.04 |
| 4 | | 15 | | 40 | 148 | 0.04 |
| 5 | I-4 | 5 | II-2 | 40 | 123 | 0.03 |
| 6 | | 10 | | 40 | 174 | 0.03 |
| 7 | | 15 | | 40 | 182 | 0.04 |
| 8 | I-6 | 5 | II-2 | 40 | 107 | 0.03 |
| 9 | | 10 | | 40 | 155 | 0.03 |
| 10 | | 15 | | 40 | 166 | 0.04 |
| 11 | I-9 | 5 | II-2 | 40 | 110 | 0.03 |
| 12 | | 10 | | 40 | 170 | 0.03 |
| 13 | | 15 | | 40 | 170 | 0.04 |
| 14 | I-11 | 5 | II-2 | 40 | 98 | 0.04 |
| 15 | | 10 | | 40 | 148 | 0.04 |
| 16 | | 15 | | 40 | 151 | 0.04 |
| 17 | I-16 | 5 | II-2 | 40 | 98 | 0.04 |
| 18 | | 10 | | 40 | 141 | 0.04 |
| 19 | | 15 | | 40 | 151 | 0.04 |
| 20 | I-18 | 5 | II-2 | 40 | 95 | 0.04 |
| 21 | | 10 | | 40 | 135 | 0.04 |
| 22 | | 15 | | 40 | 141 | 0.04 |
| 23 | Dye B | 5 | II-2 | 40 | 59 | 0.05 |
| (comparison) 24 (comparison) | | 10 | | 40 | 68 | 0.05 |
| (comparison) 25 (comparison) | | 15 | | 40 | 68 | 0.06 |

Note:
"—" in the column of sensitivity means that the measurement could not be conducted since sensitivity was too low to be determined.

Dye B:

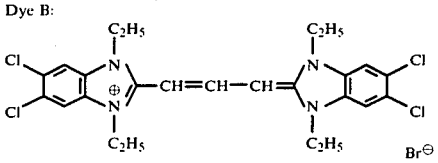

EXAMPLE 2

Chemically sensitized silver iodobromide emulsion (iodine content 6.0 mol %, average particle size 1.0 micron, gelatin content 67 g/kg emulsion; silver amount 0.7 mol/kg emulsion) was obtained. 1 kg of this emulsion was heated to be dissolved and 500 g of emulsion of Coupler C shown below was added. The emulsion of the Coupler C used was obtained by dissolving 100 g of the Coupler C into 200 ml of ethyl acetate using tricresyl phosphate, adding sodium dodecylbenzenesulfonate as emulsion dispersing auxiliary, and dispersing the mixture into 1,000 g of 10% aqueous gelatin solution by means of a homoblender. To this emulsion, a prescribed amount of a methanolic solution of sensitizing dye and a methanolic solution of the compound represented by the general formula (II) as shown in Table 3 were added and the whole was stirred for mixing. Then, 25 ml of 1.0 wt % aqueous solution of 4-hydroxy-6-methyl-1,3,3a,7-tetraazaindene, 50 ml of 2.0 wt % aqueous solution of 1-hydroxy-3,5-dichlorotriazine sodium salt and 20 ml of 2.0 wt % aqueous solution of dodecylbenzenesulfonic acid sodium salt were added and the whole was stirred. Samples were obtained by coating cellulose triacetate base film with the resulting finished emulsion so that the silver amount coated was 5 g/m$^2$, and drying the coated film. Light-wedge exposure of the film samples was conducted by means of sensitometer having a light source of color temperature of 5,400° K. provided with a green filter (BPB-53) made by Fuji Photo Film Co., Ltd. After exposure, the sample was developed using the prescription described below. After bleaching and fixing, the sample was dried and the density of magenta color image formed was measured. The base point of the optical density which determined the sensitivity was the point of (fog+0.20). The results obtained were shown in Table 3.

| Developing Treatment Prescription | |
|---|---|
| Steps | |
| 1. Color Developing | 3 min 15 sec (38° C.) |
| 2. Bleaching | 6 min 30 sec |
| 3. Washing with Water | 3 min 15 sec |
| 4. Fixing | 6 min 30 sec |
| 5. Washing with Water | 3 min 15 sec |
| 6. Stabilization | 3 min 15 sec |

The compositions of the treating solutions used in each step are as follows.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Adding water to make | 1 l |
| Bleaching Solution | |
| Ammonium Bromide | 160.0 g |
| Aqueous Ammonia (28%) | 25.0 ml |
| Ethylenediaminetetraacetic Acid Sodium Iron Salt | 130.0 g |
| Glacial Acetic Acid | 14.0 ml |
| Adding water to make | 1 l |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Adding water to make | 1 l |
| Stabilizing Solution | |
| Formalin | 8 ml |
| Adding water to make | 1 l |

Coupler C

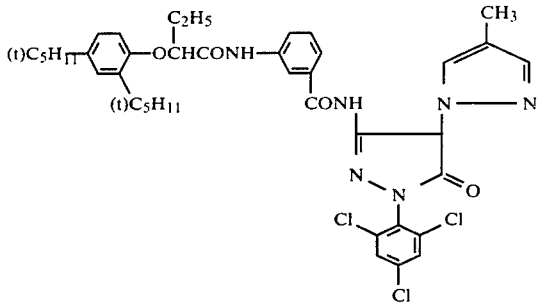

compared with the cases of dyes alone or comparative examples.

EXAMPLE 3

A silver chlorobromide photographic emulsion (Br 60 mol %, Cl 40 mol %) containing α-(4-palmitamidophenoxy)-α-pivaloyl-4-sulfoamylacetanilide (described in U.S. Pat. No. 3,408,194) as yellow dye image forming coupler was applied on a photographic paper covered with polyethylene to form a blue-sensitive emulsion layer. The blue-sensitive emulsion layer contains 4-hydroxy-6-methyl-1,3,3a,7-tetraazaindene (stabilizer), 2-n-octadecyl-5-(2-sulfo-tert-butyl)hydroquinone potassium salt (stain preventing agent) and blue-sensitive sensitizing dye. A gelatin interlayer containing dioctylhydroquinone was applied on the blue-sensitive emulsion layer. A green-sensitive emulsion layer was formed by applying a green-sensitive silver chlorobromide photographic emulsion (Br 70 mol %, Cl 30 mol %) containing 1-phenyl-3-methyl-4-(4-methylsulfonylphenoxy)-5-pyrazolone as magenta dye image forming coupler upon the gelatin interlayer. The coupler used was dispersed into tricresyl phosphate (common solvent for coupler). The green-sensitive emulsion layer contains a prescribed amount of dioctylhydroquinone (stain preventing agent), sensitizing dye of the general formula (I) of this invention and additive of the general formula (II). The gelatin layer containing dioctylhydroquinone was dispersed into tricresyl phosphate (solvent) upon the green-sensitive emulsion layer. A red-sensitive emulsion layer was formed by applying a red-sensitive silver chlorobromide photographic emulsion (Br 70 mol %, Cl 30 mol %) containing 1-hydroxy-4-maleimido-2-naphthamide as a cyan dye image forming coupler. The coupler was dispersed into dibutyl phthalate. The red-sensitive emulsion layer contains dioctylhydroquinone (stain preventing agent) and red-sensitive sensitizing dye.

After one part of the above samples was preserved at room temperature (20° C., relative humidity 60%) and another one part was preserved at this temperature and high humidity (50° C., relative humidity 80%) for two days, light-wedge exposure of the samples and follow-

TABLE 3

| Test No. | | Sensitizing Dye and Amount (× $10^{-5}$ mol/1 kg emulsion) | | | | Compound of Formula (II) and Amount (× $10^{-5}$ mol/1 kg emulsion) | | Just after Coating Sensitivity | Just after Coating Fog | After Preservation (50° C., 75%, 3 Days) Sensitivity | After Preservation (50° C., 75%, 3 Days) Fog |
|---|---|---|---|---|---|---|---|---|---|---|---|
| 1 | | I-7 | 25 | | | — | | 100 (base) | 0.06 | 76 | 0.07 |
| 2 | | | | — | | II-1 | 20 | — | 0.05 | — | 0.05 |
| 3 | | | | — | | | 40 | — | 0.05 | — | 0.05 |
| 4 | | | | — | | | 80 | — | 0.05 | — | 0.05 |
| 5 | | I-7 | 25 | | | II-1 | 20 | 151 | 0.05 | 148 | 0.05 |
| 6 | | | 25 | | | | 40 | 182 | 0.05 | 178 | 0.06 |
| 7 | | | 25 | | | | 80 | 191 | 0.05 | 186 | 0.06 |
| 8 | (comparison) | I-7 | 25 | | | Compound A | 20 | 100 | 0.07 | 74 | 0.09 |
| 9 | " | | 25 | | | | 40 | 102 | 0.08 | 69 | 0.10 |
| 10 | " | | 25 | | | | 80 | 98 | 0.09 | 66 | 0.12 |
| 11 | | I-7 | 10 | | | — | | 100 (base) | 0.05 | 69 | 0.06 |
| 12 | | | | III-1 | 10 | — | | 83 | 0.05 | 76 | 0.06 |
| 13 | | I-7 | 10 | III-1 | 10 | — | | 132 | 0.05 | 102 | 0.06 |
| 14 | | I-7 | 10 | III-1 | 10 | II-2 | 20 | 191 | 0.05 | 186 | 0.05 |
| 15 | | | 10 | | 10 | | 40 | 214 | 0.05 | 209 | 0.05 |
| 16 | | | 10 | | 10 | | 80 | 224 | 0.05 | 219 | 0.05 |
| 17 | (comparison) | I-7 | 10 | III-1 | 10 | Compound A | 20 | 132 | 0.06 | 91 | 0.08 |
| 18 | " | | 10 | | 10 | | 40 | 129 | 0.07 | 85 | 0.09 |
| 19 | " | | 10 | | 10 | | 80 | 117 | 0.08 | 71 | 0.10 |

As evident from the results shown in Table 3, the combinations of this invention provide excellent sensitive materials with high sensitivity and little fog not only just after coating but also after preservation as ing developing treatment were conducted. The density measurement was conducted by means of a P type densitometer made by Fuji Photo Film Co., Ltd. The base point of the optical density which determined the sensitivity is the point of fog+1.0. The results obtained are shown in Table 4.

TABLE 4

| Test No. | | Sensitizing Dye and Amount ($\times 10^{-5}$ mol/kg emulsion) | | Compound of Formula (II) and Amount ($\times 10^{-5}$ mol/kg emulsion) | | Preserved at Room Temperature | | Preserved at High Temperature and High Humidity (50° C., 80% RH) | |
|---|---|---|---|---|---|---|---|---|---|
| | | | | | | Sensitivity | Fog | Sensitivity | Fog |
| 1 | | I-8 | 15 | — | | 100 (base) | 0.04 | 72 | 0.05 |
| 2 | | — | | II-5 | 40 | — | 0.04 | — | 0.04 |
| 3 | | — | | | 80 | — | 0.04 | — | 0.04 |
| 4 | | I-8 | 15 | II-5 | 40 | 132 | 0.04 | 129 | 0.04 |
| 5 | | | 15 | | 80 | 148 | 0.04 | 145 | 0.04 |
| 6 | (comparison) | I-8 | 15 | Compound A | 40 | 100 | 0.04 | 69 | 0.06 |
| 7 | " | | 15 | | 80 | 102 | 0.04 | 66 | 0.07 |
| 8 | " | Dye B | 15 | — | | 91 | 0.04 | 69 | 0.05 |
| 9 | " | | 15 | II-5 | 40 | 93 | 0.04 | 71 | 0.06 |
| 10 | " | | 15 | | 80 | 95 | 0.04 | 71 | 0.06 |

Color Developing Treatment

| Treating Steps | Temperature | Time |
|---|---|---|
| Color Developing | 30° C. | 6 min |
| Stopping | " | 2 min |
| Washing with Water | " | 2 min |
| Bleach-Fixing | " | 1 min 30 sec |
| Washing with Water | " | 2 min |
| Stabilizing Bath | " | 2 min |
| Drying | | |

The treating solutions had the following compositions.

| | |
|---|---|
| Color Developing Solution | |
| Benzyl Alcohol | 12.0 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Ethylenediaminetetraacetic Acid Disodium Dihydrate | 2.0 g |
| 4-Amino-3-methyl-N—ethyl-N—(β-methanesulfonamidoethyl)aniline Sesquisulfate Monohydrate | 5.0 g |
| Adding water to make a total of | 1 l |
| Stopping Solution | |
| Sodium Thiosulfate | 10 g |
| Ammonium Thiosulfate (70%) | 30 ml |
| Sodium Acetate | 5 g |
| Acetic Acid | 30 ml |
| Potash Alum | 15 g |
| Adding water to make a total of | 1 l |
| Bleach-Fixing Solution | |
| Ferric Sulfate | 20 g |
| Ethylenediaminetetraacetic Acid Disodium Dihydrate | 36 g |
| Sodium Carbonate Monohydrate | 17 g |
| Sodium Sulfite | 5 g |
| 70% Aqueous Ammonium Thiosulfate Solution | 100 ml |
| Boric Acid | 5 g |
| Adjusting pH at 6.8 and adding water to make a total of | 1 l |
| Stabilizing Solution | |
| Boric Acid | 5 g |
| Sodium Citrate | 5 g |
| Sodium Metaborate Tetrahydrate | 3 g |
| Potash Alum | 15 g |
| Adding water to make a total of | 1 l |

As evident from the results shown in Table 4, the combinations of this invention provide excellent sensitive materials with high sensitivity and little fog even after preservation as compared with the case of dye alone or comparative examples.

EXAMPLE 4

Multilayered color photosensitive film was prepared by applying a first layer (lowermost layer) to sixth layer (uppermost layer) upon a cellulose triacetate support as shown in the following Table 5. (In the table, mg/m$^2$ means the amount applied.)

TABLE 5

| | | |
|---|---|---|
| Sixth Layer (protecting layer) | Gelatin | 750 mg/m$^2$ |
| Fifth Layer (green-sensitive layer) | Silver chlorobromide emulsion (silver bromide 30 mol %) | |
| | Silver | 500 mg/m$^2$ |
| | Magenta coupler (*1) | 600 mg/m$^2$ |
| | Coupler solvent (*2) | 110 mg/m$^2$ |
| | Gelatin | 1,300 mg/m$^2$ |
| Fourth Layer (interlayer) | Gelatin | 500 mg/m$^2$ |
| Third Layer (red-sensitive layer) | Silver chlorobromide emulsion (silver bromide 30 mol %) | |
| | Silver | 500 mg/m$^2$ |
| | Sensitizing dye (*3) | 0.13 mg/m$^2$ |
| | Cyan coupler (*4) | 1,500 mg/m$^2$ |
| | Coupler solvent (*5) | 700 mg/m$^2$ |
| | Gelatin | 2,900 mg/m$^2$ |
| Second Layer (interlayer) | Gelatin | 500 mg/m$^2$ |
| First Layer (blue-sensitive layer) | Silver iodobromide emulsion (silver iodide 0.2 mol %) | |
| | Silver | 100 mg/m$^2$ |
| | Sensitizing dye (*6) | 0.2 mg/m$^2$ |
| | Stabilizer (*7) | 4 mg/m$^2$ |
| | Yellow coupler (*8) | 1,200 mg/m$^2$ |
| | Coupler solvent (*2) | 600 mg/m$^2$ |
| | Gelatin | 2,200 mg/m$^2$ |

TABLE 5-continued

| Support | Cellulose triacetate |
|---|---|

(*1) Coupler: 3-{3-[2-(2,4-Di-tert-amylphenoxy)-acetamido]benzamido}-1-(2,4,6-trichlorophenyl)-2-pyrazolin-5-one, used as a dispersion in solvent
(*2) Solvent: Tricresyl phosphate
(*3) Sensitizing dye: 3,3'-Di(3-sulfopropyl)-5,5',6,6',10-heptamethylthiadicarbocyanine sodium salt, used as a methanolic solution
(*4) Coupler: 2-[α-(2,4-Di-tert-pentylphenoxy)-butanamido]-4,6-dichloro-5-methylphenol, used as a dispersion in solvent
(*5) Solvent: Dibutyl phthalate
(*6) Sensitizing dye: 3-Phenyl-5-[3-(3-sulfopropyl)-2-benzoxazolinidene]rhodanine sodium salt, used as a methanolic solution
(*7) Stabilizer: 4-Hydroxy-6-methyl-1,3,3a,7-tetraazaindene
(*8) Coupler: α-Pivaloyl-α-(2,4-dioxy-5,5'-dimethyloxazolidine-3-yl)-2-chloro-5-[α-(2,4-di-tert-pentyloxy)butanamido]-acetanilide, used as a dispersion in solvent Samples 1 to 8 were prepared by adding sensitizing dye and compound in the fifth layer of the photosensitive film as shown in Table 6.

Each sample film was exposed with green light through successive wedges and thereafter developing treatment was conducted. The results are shown in Table 6.

| | Temperature | Time |
|---|---|---|
| Developing Treatment Steps | | |
| Color Developing | 36° C. | 3 min |
| Stopping | " | 40 sec |
| First Fixing | " | 40 sec |
| Bleaching | " | 1 min |
| Second Fixing | " | 40 sec |
| Washing with Water | " | 30 sec |
| Composition of Color Developing Solution | | |
| Sodium Sulfite | | 5 g |
| 4-Amino-3-methyl-N,N—diethylaniline | | 3 g |
| Sodium Carbonate | | 20 g |
| Potassium Bromide | | 2 g |
| Adding water to make | | 1 l |
| | | pH 10.5 |
| Composition of Stopping Solution | | |
| Sulfuric Acid (6 N) | | 50 ml |
| Adding water to make | | 1 l |
| | | pH 1.0 |
| Composition of Fixing Solution | | |
| Ammonium Thiosulfate | | 60 g |
| Sodium Sulfite | | 2 g |
| Sodium Hydrogensulfite | | 10 g |
| Adding water to make | | 1 l |
| | | pH 5.8 |
| Composition of Bleaching Solution | | |
| Potassium Ferricyanide | | 30 g |
| Potassium Bromide | | 15 g |
| Adding water to make | | 1 l |
| | | pH 6.5 |

TABLE 6

| Test No. | Sensitizing Dye and Amount (× $10^{-4}$ mol/kg emulsion) | | Compound and Amount (× $10^{-4}$ mol/kg emulsion) | | Preserved at Room Temperature (4 Days) Sensitivity | Fog | Preserved at High Temperature (50° C., 70% RH, 4 Days) Sensitivity | Fog |
|---|---|---|---|---|---|---|---|---|
| 1 | I-13 10 | | — | | 100 (base) | 0.03 | 78 | 0.04 |
| 2 | 10 | | II-3 | 5 | 129 | 0.03 | 123 | 0.03 |
| 3 | 10 | | | 10 | 145 | 0.03 | 138 | 0.03 |
| 4 | 10 | | | 20 | 166 | 0.03 | 162 | 0.03 |
| 5 | 10 | | | 40 | 174 | 0.03 | 170 | 0.03 |
| 6 | I-13 10 | III-4 10 | — | | 135 | 0.03 | 104 | 0.04 |
| 7 | 10 | 10 | II-3 | 20 | 219 | 0.03 | 214 | 0.03 |
| 8 | 10 | 10 | | 40 | 240 | 0.03 | 234 | 0.03 |

As evident from the results shown in Table 6, the combinations of this invention provide excellent sensitive materials with high sensitivity and little fog even after preservation as compared with the case of using dye alone.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion, comprising:

a binder having dispersed therein:

silver halide grains;

a sensitizing dye represented by general formula (I); and a compound represented by general formula (II):

(I)

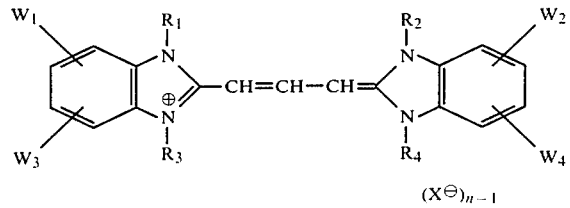

wherein:

$W_1$, $W_2$, $W_3$ and $W_4$, which may be the same or different, each represents a hydrogen atom, a halogen atom, an alkyl group, a cycloalkyl group, an alkenyl group, an acyl group, an acyloxy group, an alkoxycarbonyl group, a carbamoyl group, a sulfamoyl group, a cyano group, a trifluromethyl group or a hydroxy group;

$R_1$, $R_2$, $R_3$ and $R_4$, which may be the same or different, each represents an unsubstituted or substituted alkyl group; an unsubstituted or substituted cycloalkyl group or an unsubstituted or substituted alkenyl group, provided that at least one of $R_3$ and $R_4$ represents a substituted alkyl, cycloalkyl or alkenyl group containing a sulfo group or a carboxy group;

X represents an acid anion;

n represents 1 or 2;

(II)

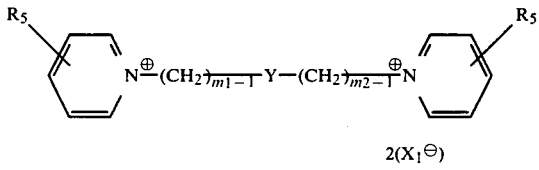

wherein:

$R_5$ represents a hydrogen atom, a halogen atom, an alkyl group, an alkoxycarbonyl group, an acyloxy group, an alkoxy group, an amino group, a substituted amino group, an acylamido group or a carbamoyl group;

Y represents an alkylene group, an arylene group, an aralkylene group, —COO— or —COO—$Y_1$—OCO— where $Y_1$ represents an alkylene group, an arylene group or an aralkylene group;

$X_1$ represents an anion;

$m_1$ and $m_2$ each represents an integer of from 1 to 19.

2. A silver halide photographic emulsion as claimed in claim 1, wherein $W_1$, $W_2$, $W_3$ amd $W_4$ independently represent a halogen atom, an alkyl group having not more than 6 carbon atoms, a cycloalkyl group having not more than 8 carbon atoms, an alkenyl group having not more than 6 carbon atoms, an acyl group having not more than 8 carbon atoms, an acyloxy group having not more than 3 carbon atoms, an alkoxycarbonyl group having not more than 8 carbon atoms, a carbamoyl group having not more than 8 carbon atoms, a sulfamoyl group having not more than 8 carbon atoms, a cyano group, a trifluoromethyl group or a hydroxy group.

3. A silver halide photographic emulsion as claimed in claim 1, wherein $R_1$, $R_2$, $R_3$ and $R_4$ independently represent an alkyl group having not more than 8 carbon atoms, a cycloalkyl group having not more than 8 carbon atoms, an alkenyl group having not more than 8 carbon atoms.

4. A silver halide photographic emulsion as claimed in claim 3, wherein said alkyl, cycloalkyl or alkenyl group is substituted with a halogen atom, a hydroxy group, an alkoxycarbonyl group having not more than 8 carbon atoms, an alkoxy group having not more than 7 carbon atoms, an aryloxy group having not more than 12 carbon atoms, an acyloxy group having not more than 3 carbon atoms, an acyl group having not more than 8 carbon atoms, a carbamoyl group having not more than 8 carbon atom, a sulfamoyl group having not more than 8 carbon atoms or an aryl group having not more than 12 carbon atoms.

5. A silver halide photographic emulsion as claimed in claim 1, wherein $R_5$ represents a hydrogen atom, a halogen atom, an alkyl group from 1 to 18 carbon atoms, an alkoxycarbonyl group having from 1 to 18 carbon atoms, an acyloxy group having from 1 to 18 carbon atoms, an alkoxy group having from 1 to 18 carbon atoms, an amino group, a substituted amino group having from 1 to 18 carbon atoms, an acylamido group having from 1 to 18 carbon atoms or a carbamoyl group having from 1 to 18 carbon atoms.

6. A silver halide photographic emulsion as claimed in claim 1, wherein Y represents an alkylene group having from 1 to 18 carbon atoms, an arylene group having from 6 to 18 carbon atoms or an aralkylene group having from 7 to 18 carbon atoms.

7. A silver halide photographic emulsion as claimed in claim 1, wherein the sensitizing dye of general formula (I) is present in a ratio of from $1\times10^{-6}$ mol to $5\times10^{-3}$ mol per mol of silver halide.

8. A silver halide photographic emulsion as claimed in claim 7, wherein the sensitizing dye of general formula (I) is present in a ratio of from $1\times10^{-5}$ mol to $2.5\times10^{-3}$ mol per mol of silver halide.

9. A silver halide photographic emulsion as claimed in claim 8, wherein the sensitizing dye of general formula (I) is present in an amount in the range of from $4\times10^{-5}$ mol to $1\times10^{-3}$ mol per mol of silver halide.

10. A silver halide photographic emulsion as claimed in claim 1, wherein the compound of general formula (II) is present in an amount in the range of 0.01 g to 5 g per mol of silver halide.

11. A silver halide photographic emulsion as claimed in claim 1, wherein the weight ratio of the sensitizing dye of general formula (I) to the compound of general formula (II) is in the range of from 4/1 to 1/100.

12. A silver halide photographic emulsion as claimed in claim 11, wherein the weight ratio of the sensitizing dye of general formula (I) to the compound of general formula (II) is in the range of from 2/1 to 1/40.

13. A silver halide photographic emulsion as claimed in claim 1, further comprising a sensitizing dye represented by formula (III):

(III)

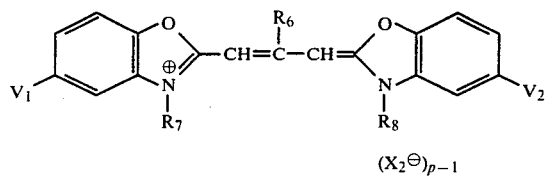

wherein $R_7$ and $R_8$ independently represent the same meaning as $R_3$ and $R_4$, and at least one of $R_7$ and $R_8$ represents a substituted alkyl, cycloalkyl or alkenyl group containing a sulfo group or a carboxy group; $R_6$ represents an ethyl group or a propyl group; $V_1$ and $V_2$ independently represent an alkyl group, an alkoxy group, a halogen atom, a phenyl group, a carboxy group, a hodorxy group; $X_2$ represents an acid anion, and p represents 1 or 2.

14. A silver halide photographic emulsion as claimed in claim 13, wherein $V_1$ and $V_2$ independently represent an alkyl group having not more than 4 carbon atoms, an alkoxy group having not more than 4 carbon atoms, a halogen atom, a phenyl group, a carboxy group or a hydroxy group.

15. A silver halide photographic emulsion as claimed in claim 13, wherein the sensitizing dye of general formula (III) is present in such an amount that the molar ratio of the sum of the sensitizing dye of the general formula (I) and the sensitizing dye of the general formula (III) to the silver halide is from $1\times10^{-6}$ mol to $5\times10^{-3}$ mol per mol of silver halide, and that the molar ratio of the sensitizing dye of the formula (II) to the sensitizing dye of the formula (I) is from 1:10 to 10:1.

16. A silver halide photographic emulsion as claimed in claim 15, wherein the sensitizing dye of general formula (III) is present in such an amount that the molar ratio of the sum of the sensitizing dye of the general formula (I) and the sensitizing dye of the general formula (III) to the silver halide is in the range of $1\times10^{-5}$ to $2.5\times10^{-3}$ mol of silve halide.

17. A silver halide photographic emulsion as claimed in claim 16, wherein the sensitizing dye of general formula (III) is present in such an amount that the molar ratio of the sum of the sensitizing dye of the general formula (I) and the sensitizing dye of the general formula (III) to the silver halide is in the range of $4\times10^{-5}$ mol to $1\times10^{-3}$ mol per mol of silver halide.

* * * * *